US007967060B2

(12) United States Patent
Trumbower et al.

(10) Patent No.: US 7,967,060 B2
(45) Date of Patent: Jun. 28, 2011

(54) EVAPORATING HEAT EXCHANGER

(75) Inventors: Michael W. Trumbower, New Haven, IN (US); Nazih Khatib, Ann Arbor, MI (US)

(73) Assignee: Parker-Hannifin Corporation, Cleveland, OH (US)

( * ) Notice: Subject to any disclaimer, the term of this patent is extended or adjusted under 35 U.S.C. 154(b) by 371 days.

(21) Appl. No.: 11/465,652

(22) Filed: Aug. 18, 2006

(65) Prior Publication Data

US 2007/0039724 A1 Feb. 22, 2007

Related U.S. Application Data

(60) Provisional application No. 60/709,176, filed on Aug. 18, 2005, provisional application No. 60/732,974, filed on Nov. 3, 2005.

(51) Int. Cl.
*F28F 9/02* (2006.01)
*F25B 39/02* (2006.01)

(52) U.S. Cl. ..... 165/174; 165/175

(58) Field of Classification Search ..... 165/153, 165/174, 175, 176, 178; 62/509, 515, 524–525
See application file for complete search history.

(56) References Cited

U.S. PATENT DOCUMENTS

| | | | | | |
|---|---|---|---|---|---|
| 1,313,518 | A | * | 8/1919 | Clark | 165/174 |
| 2,097,602 | A | * | 11/1937 | Rohlin | 237/74 |
| 2,099,186 | A | | 11/1937 | Anderegg | 257/248 |
| 2,825,317 | A | * | 3/1958 | Tacchella et al. | 123/41.23 |
| 3,976,128 | A | * | 8/1976 | Patel et al. | 165/153 |
| 4,302,949 | A | * | 12/1981 | Trimboli Longhetto | 62/402 |
| 4,513,587 | A | | 4/1985 | Humpolik et al. | 62/515 |
| 4,524,823 | A | * | 6/1985 | Hummel et al. | 165/174 |
| 4,593,539 | A | | 6/1986 | Humpolik et al. | 62/504 |
| 5,513,700 | A | * | 5/1996 | Kleve et al. | 165/153 |
| 5,651,268 | A | * | 7/1997 | Aikawa et al. | 62/525 |
| 5,711,370 | A | * | 1/1998 | Tanaka | 165/178 |
| 5,806,586 | A | | 9/1998 | Osthues et al. | 165/174 |
| 5,835,976 | A | * | 11/1998 | Kent et al. | 73/40.7 |
| 6,688,137 | B1 | | 2/2004 | Gupte | |
| 6,814,136 | B2 | | 11/2004 | Yi et al. | 165/153 |
| 7,044,200 | B2 | | 5/2006 | Gupte et al. | 165/103 |
| 2005/0262872 | A1 | | 12/2005 | Sacks et al. | |

FOREIGN PATENT DOCUMENTS

| | | | |
|---|---|---|---|
| JP | 2004-232924 | | 8/2004 |
| JP | 2004232924 | A * | 8/2004 |

* cited by examiner

*Primary Examiner* — Tho V Duong
(74) *Attorney, Agent, or Firm* — Renner, Otto, Boisselle & Sklar, LLP

(57) ABSTRACT

An evaporating heat exchanger (12) comprises a multitude of parallel channels (40) extending between vertical header pipes (30,32) and forming flow passages (44) from the inlet chamber (34) and to the outlet chamber (36). A venturi device (50) is positioned within the inlet chamber (34) to ensure even mass distribution of refrigerant to the flow passages (44).

12 Claims, 8 Drawing Sheets

EVAPORATING HEAT EXCHANGER

RELATED APPLICATIONS

This application claims priority under 35 U.S.C. §119(e) to U.S. Provisional Patent Application No. 60/709,176 filed on Aug. 18, 2005 and U.S. Provisional Patent Application No. 60/732,974 filed on Nov. 3, 2005. The entire disclosures of these provisional applications are hereby incorporated by reference.

GENERAL FIELD

This disclosure relates generally to an evaporating heat exchanger and, more particularly, to an evaporator for a heatpump system having a first header pipe, a second header pipe, and a multitude of parallel microchannels extending between the first header pipe and the second header pipe and forming flow passages from an inlet chamber to an outlet chamber.

BACKGROUND

A heatpump system (i.e., a refrigerant system) can be used to control the temperature of a certain medium such as, for example, the air inside of a building or automobile. A heatpump system generally comprises an evaporating heat exchanger (e.g., an evaporator), a compressor, a condensing heat exchanger (e.g., a condenser), a metering device (e.g., a metering/expansion valve), and a series of lines (e.g., pipes, tubes, ducts) connecting these components together so that refrigerant fluid can cycle therethrough.

In a heatpump system, refrigerant fluid enters the evaporating heat exchanger as a low pressure and low temperature vapor-liquid. As the vapor-liquid passes through the evaporator, it is boiled into a low pressure gas state. The fluid from the evaporator is drawn through the compressor, which increases the pressure and temperature of the gas. From the compressor, the high pressure and high temperature gas passes through the condensing heat exchanger whereat it is condensed to a liquid. The condensed liquid is then passed through the metering device whereat it is converted into the low pressure and low temperature vapor liquid for entry into the evaporator to complete the cycle.

An evaporating heat exchange typically comprises one or more flow passages through which refrigerant fluid travels from the inlet to the outlet of the evaporator. As the evaporator absorbs heat from the surrounding medium, refrigerant fluid within the flow passages evaporates. Ideally, an equal ratio of gas-to-liquid refrigerant will travel through each flow passage of an evaporating heat exchanger, as this yields a high heat transfer rate. A high heat transfer rate can translate into improved performance, greater efficiency, reduced power consumption, increased capacity and/or smaller package size.

SUMMARY

An evaporating heat exchanger is provided wherein a venturi device ensures that an equal ratio of gas-to-liquid refrigerant) will travel through each passage of a parallel flow heat exchanger. The venturi device eliminates the need for a pre-evaporator split of fluid into multiple feeder tubes and/or complicated baffling arrangements within the header pipe. The device can also be designed to prevent over-accumulation of liquid refrigerant in the inlet chamber and/or can be used in conjunction with a conduit to further facilitate even flow distribution. Thus, a microchannel parallel-flow heat exchanger (e.g., a parallel-flow-style heat exchanger having a multitude of micro-diameter channels) can effectively be used in a heatpump system instead of its less-efficient heat exchanging cousins (e.g., a coiled tube and/or a plate-fin style heat exchanger).

These and other features of the evaporating heat exchanger (and related components and systems) are fully described and particularly pointed out in the claims. The following description and annexed drawings set forth in detail certain illustrative embodiments, these embodiments being indicative of but a few of the various ways in which the principles may be employed.

DRAWINGS

DETAILED DESCRIPTION

Figure 1:
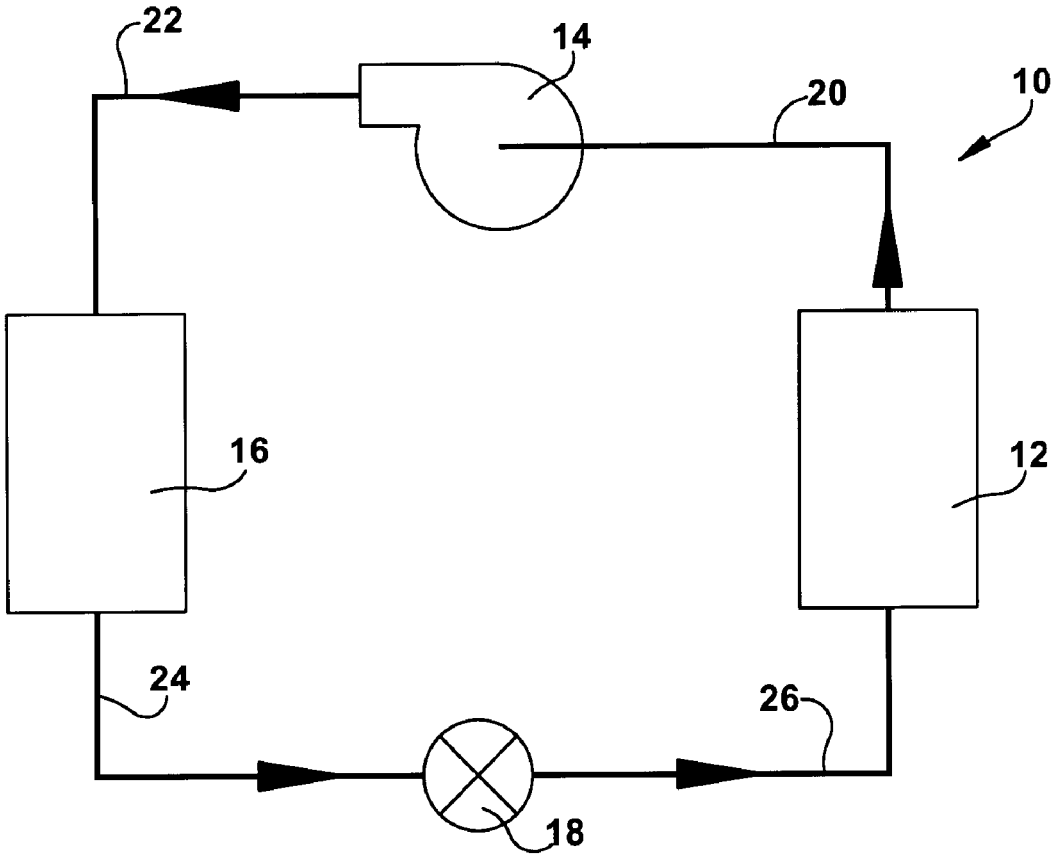
FIG. 1 is a schematic illustration of a heatpump system including an evaporating heat exchanger.

Referring now to the drawings, and initially to FIG. 1, a heatpump system 10 is schematically shown. The heatpump system 10 can be used to control the temperature of a certain medium (e.g., air in the cabin of a vehicle) and generally comprises a heat exchanger 12, a compressor 14, a heat exchanger 16, and a metering device 18. A plurality of lines connect the components 12, 14, 16 and 18 so that refrigerant fluid can cycle therethrough. In the illustrated embodiment, line 20 connects the outlet of the heat exchanger 12 to the suction of the compressor 14, the line 22 connects the discharge of the compressor 14 to the inlet of the heat exchanger 16, the line 24 connects the outlet of the heat exchanger 16 to the inlet of the metering device 18, and the line 26 connects the outlet of the metering device 18 to the inlet of the heat exchanger 12. For the purposes of the present disclosure, the term "line" means any pipe, tube, duct or other device(s), in tandem, series, parallel or otherwise, through which fluid is circulated through the heatpump system 10.

In the illustrated embodiment, the heatpump system 10 is operates in a forward (cooling) direction whereby the system 10 is a refrigeration system and/or air-conditioning system. The heat exchanger 12 is the evaporating heat exchanger (i.e., the evaporator) and is positioned within or adjacent to the medium. The heat exchanger 16 is the condensing heat exchanger (i.e., the condenser) and is positioned remote from the medium.

Refrigerant fluid exits the evaporating heat exchanger 12 as low pressure gas, and is drawn by suction to the compressor 14 (via line 20). The compressor 14 increases the pressure and temperature of gaseous refrigerant for conveyance to the condensing heat exchanger 16 (via line 22). In the condenser 16, the refrigerant is condensed to a high pressure and low temperature liquid. En route back to the evaporator 12 (via line 24), the high pressure liquid is passes through the metering device 18 whereat its pressure is reduced. The pressure-reduced refrigerant fluid enters the evaporating heat exchanger 12 (via line 26) as low pressure and low temperature vapor-liquid. As the vapor-liquid passes through the evaporator 12, it is boiled into low pressure gas, which is drawn by the compressor 14 (via line 20) to repeat the cycle.

Figure 2:
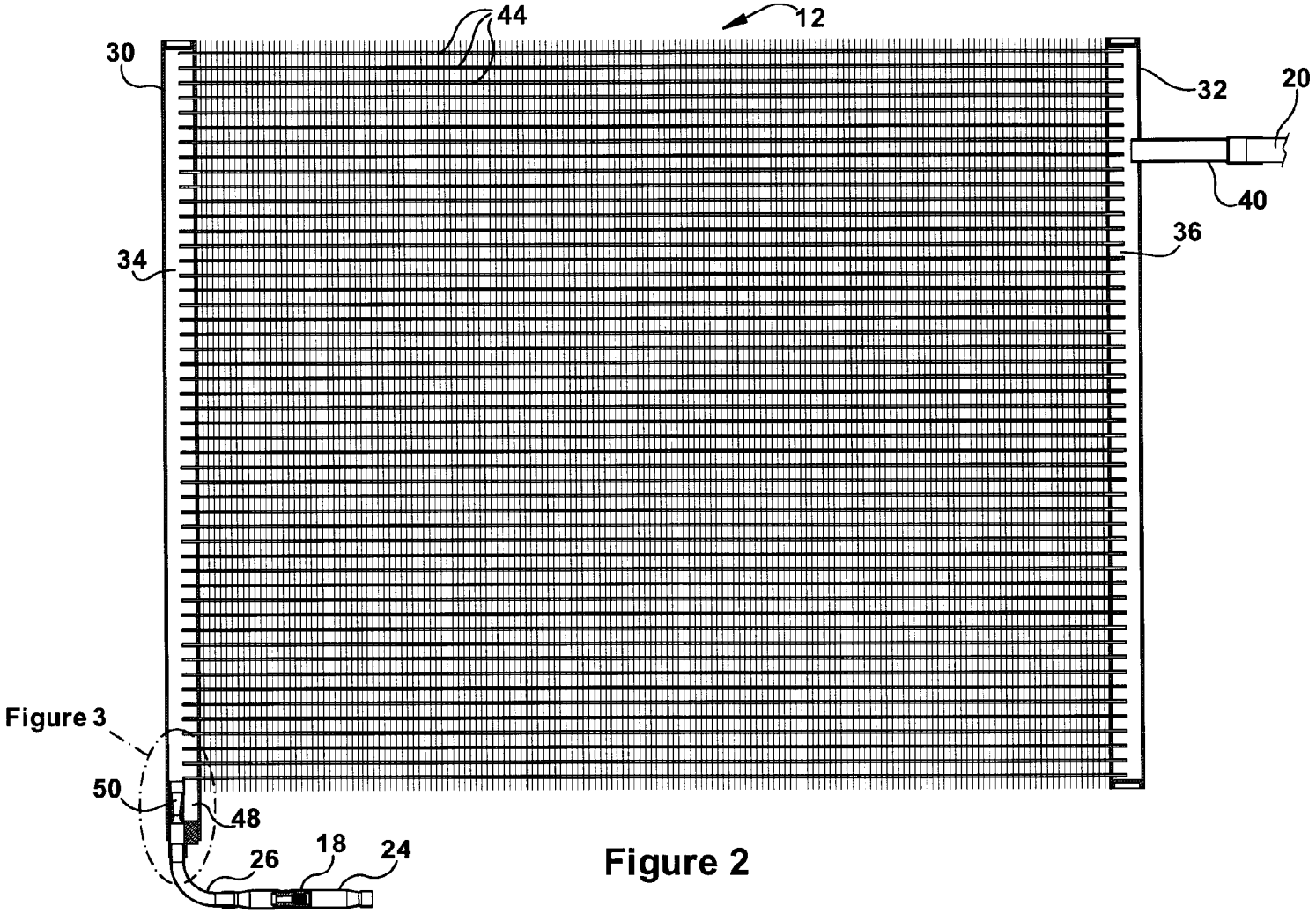
FIG. 2 is a sectional view of a single-pass evaporating heat exchanger including a venturi device.

Referring now to FIG. 2, the evaporating heat exchanger 12 is shown isolated from the rest of the heatpump system 10. The evaporator 12 comprises a first header pipe 30, a second header pipe 32, an inlet chamber 34 within the first header pipe 30 and an outlet chamber 36 within the second header pipe 32. The first header pipe 30 is connected to the line 26 from the metering device 18 and the second header pipe 34 is connected, via outlet pipe 40, with the line 20 to the compressor 14. The evaporator 12 further comprises a plurality of channels 44 extending between the first header pipe 30 and the second header pipe 32 and forming flow passages from the inlet chamber 34 and to the outlet chamber 36. The suction of the compressor 14 pulls the refrigerant fluid from the inlet chamber 34, through the flow channels 44, into the outlet chamber 36 and then through the outlet pipe 40 to the compressor-intake line 20.

The header pipes 30 and 32 can be vertically oriented, as shown, with the lower end of the first header pipe 30 forming its inlet and the upper end of the second pipe 32 forming its outlet. Other orientations of the header pipes 30 and 32 are certainly possible and contemplated. However, it may be noted that in this common (and often desired) vertical orientation of the first header pipe 30, liquid has a tendency to accumulate in a lower area 48 of the inlet chamber 34.

The channels 44 can be microchannels, that is channels having micro-sized flow areas. For example, if the channels 44 are rectangular in cross-section, they can have a width and a length between about 0.1 mm to about 40 mm, about 1 mm to about 30 mm, and/or about 1 mm to about 20 mm. One dimension can be somewhat greater than the other dimension, such as about 70% greater and/or about 80% greater. For example, the width/length can be between about 0.1 mm and about 10 mm, and the length/width can be between about 5 mm and about 40 mm. The channels 44 can have approximately the same flow areas, or their flow areas can differ in a sequential, staggered, or other manner. Likewise, the spacing between adjacent channels 44 can be the same throughout the length of the inlet chamber 34, or inter-channel spacing can be varied.

The small or micro-sized channels 44 allow the evaporator 12 to host a multitude of channels in a relatively small space, thereby significantly increasing its effective heat exchange area. The heat exchanger 12 can include, for example, more than about twenty channels 44, more than about fifty channels 44, and/or more than about a hundred channels 44. Additionally or alternatively, for example, the heat exchanger 12 can include at least one channel 44, at least two channels 44, at least five channels 44, and/or at least ten channels 44, per about 1 cm length of the first header pipe 30.

A venturi device 50 is positioned at, in, or near an upstream area of the inlet chamber 34. The illustrated heatpump system 10 operates in the forward (cooling) direction whereby the venturi device 50 is used in conjunction with the heat exchanger 12. If the heatpump system 10 was operating in a reverse (i.e., heating) direction, the venturi device 50 could be used in conjunction with the heat exchanger 16. Also, if the system 10 was designed to operate in both the forward and reverse directions, a venturi device 50 could be provided for both heat exchangers 12 and 16 with, for example, venturi-bypasses being provided to accommodate flow to/from non-evaporating heat exchanger.

Figure 3:
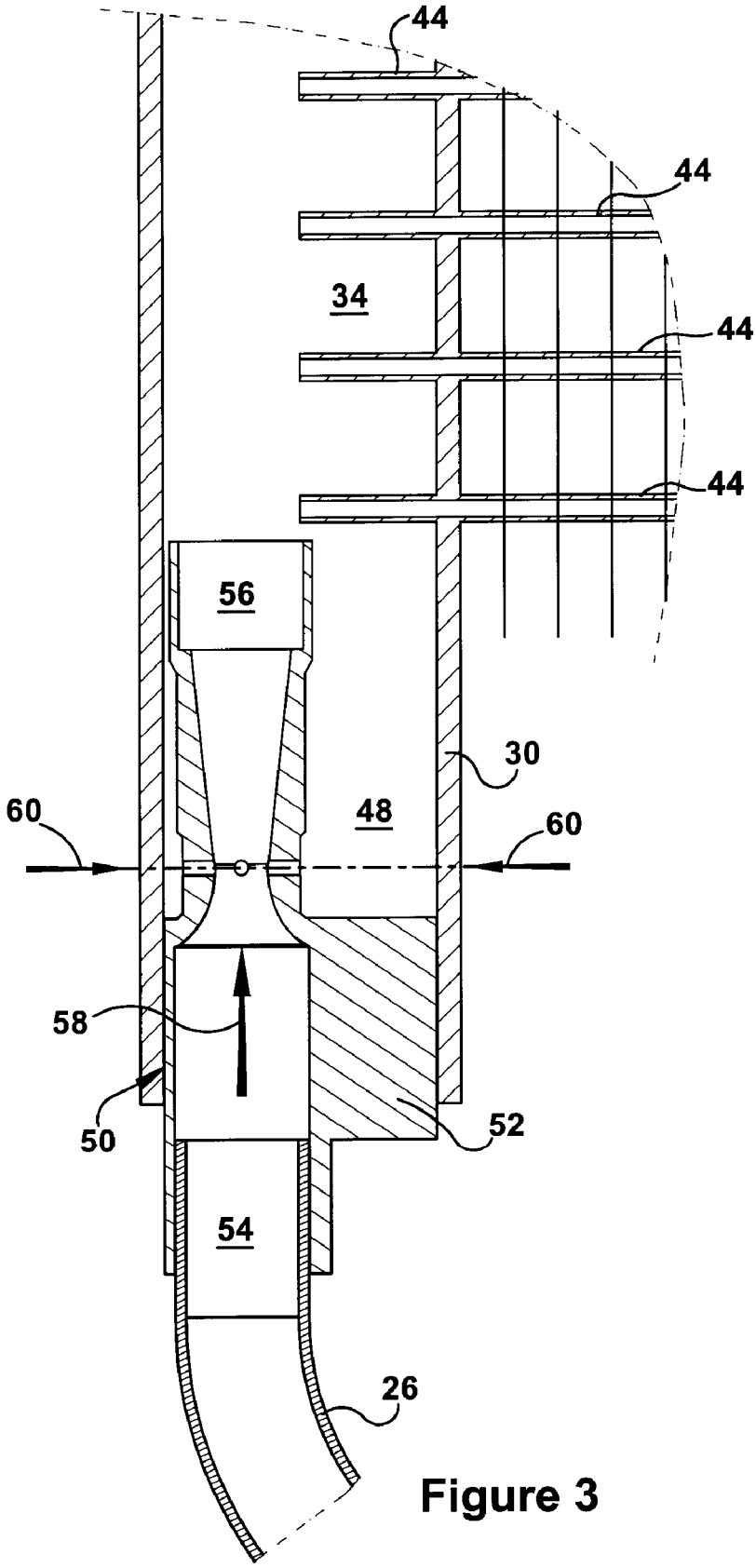
FIG. 3 is an enlarged view of the venturi device and surrounding sections of the evaporating heat exchanger.
Figure 4A:
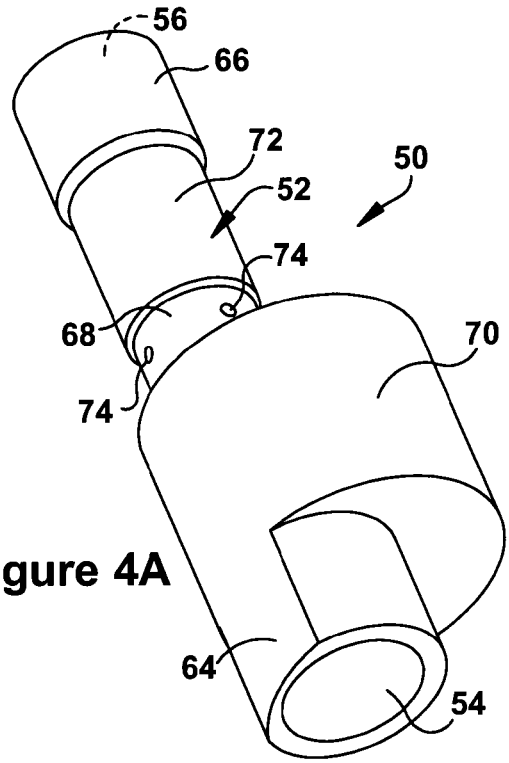
FIGS. 4A-4C are perspective, front, and sectional views of the venturi device.
Figure 4B:
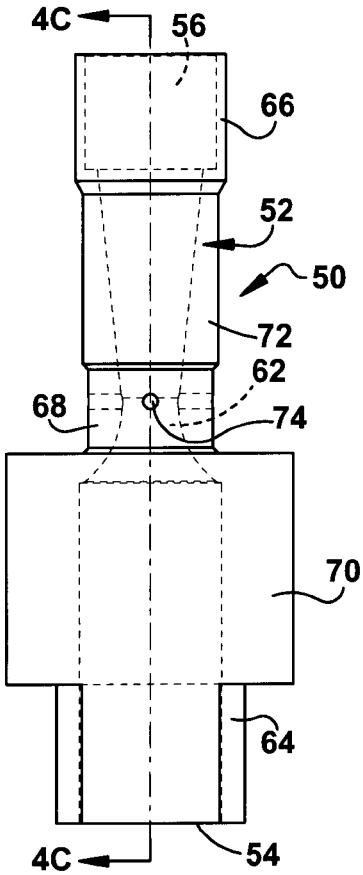
Figure 4C:
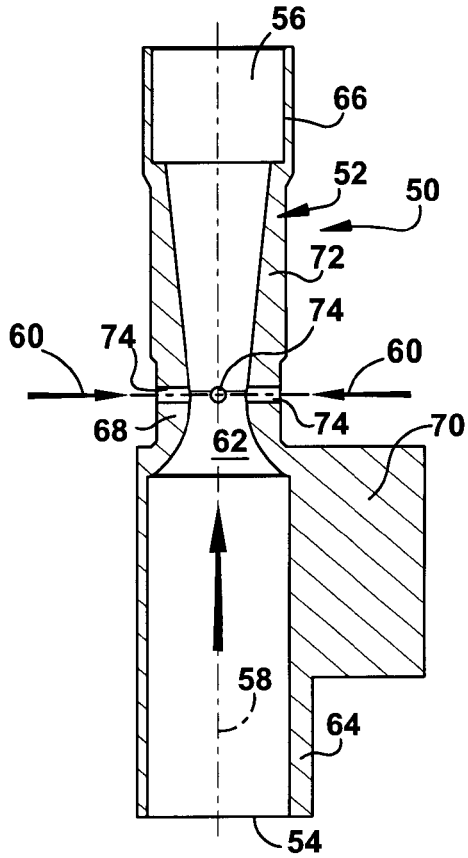

Referring now additionally to FIG. 3 and FIGS. 4A-4B, the venturi device 50 has a body 52 which defines an entrance 54, an exit 56, a primary flow path 58 between the entrance 54 and the exit 56, and an induced flow path 60 from the inlet chamber 34 to the primary flow path 58. The primary flow path 58 includes a diverging-converging throat 62 downstream of the entrance 54 and upstream of the exit 56. As the liquid-vapor refrigerant travels through the primary flow path 58 and encounters the throat 62, its velocity is increased thereby causing it to enter the inlet chamber 34 at an increased speed. It may be noted for future reference that the static pressure of the liquid-refrigerant in the primary flow path also drops as it travels through the throat 62.

The accelerated entry caused by the venturi device 50 distributes the liquid-vapor refrigerant throughout the length of the inlet chamber 34 thereby facilitating an even distribution of refrigerant among the channels 44. An equal ratio of gas-to-liquid refrigerant traveling through each channel 44 yields a high heat transfer rate, which translates into improved performance, greater efficiency, reduced power consumption, increased capacity and/or smaller package size. Significantly, this even distribution of refrigerant mass is accomplished without pre-evaporator splits of fluid into multiple feeder tubes and/or complicated baffling arrangements within the header pipe.

The body 52 includes a flange portion 64 surrounding the entrance 54, a flange portion 66 surrounding the exit 56, and a throat-defining portion 68 therebetween. An upstream transition portion 70 is located between the entrance flange portion 64 and the throat-defining portion 68. A downstream transition portion 72 is located between the throat-defining portion 68 and the exit flange portion 66. The venturi device 50 may be concentrically situated relative to the first header pipe 30 or, as illustrated, it may be axially offset to one side (e.g., the side remote from the channels 44). If the venturi device 50 is offset, the upstream transition portion 70 can be non-symmetrically shaped, relative to the primary flow path 58, to be concentric with and/or correspond to the axial end of the first header pipe 30.

The body 52 further comprises at least one opening 74 through the throat-defining portion 68 which forms the induced flow path 60 from the inlet chamber 34 to the primary flow path 58. The throat 62 of the venturi device 50, and/or the openings 74 are located at a position coinciding with the liquid-accumulation-susceptible region 48 of the inlet chamber 34. When liquid-vapor refrigerant travels in the primary flow path 58 through the venturi throat 62, the resultant pressure drop causes liquid refrigerant from the region 48 to be drawn through the openings 74 and travel in the induced flow path 60. The liquid refrigerant mixes with the liquid-vapor refrigerant in the primary flow path 58 for reintroduction into the inlet chamber 34. The removal of liquid refrigerant from the region 48 assures that the level of liquid within the inlet chamber 34 does not exceed a certain level. Also, the injection of the liquid refrigerant into the primary flow path 58 can further facilitate an even distribution of refrigerant among the channels 44.

In the illustrated embodiment, four openings 74 form the induced flow path 60 in the venturi device 50. The openings 74 are of approximately the same size and are equally spaced around the perimeter (e.g., circumference) of the throat-defining portion 68. However, openings 74 of different sizes and/or different spacings are possible and contemplated. The objective is to obtain the appropriate flow characteristics (e.g., mass, volume, velocity, etc.) of the liquid refrigerant through the induced flow path 60 to adequately drain the liquid-accumulation-susceptible area 48 of the inlet chamber 34 while not preventing the primary flow path 58 from evenly distributing refrigerant among the channels 44.

Figure 5:
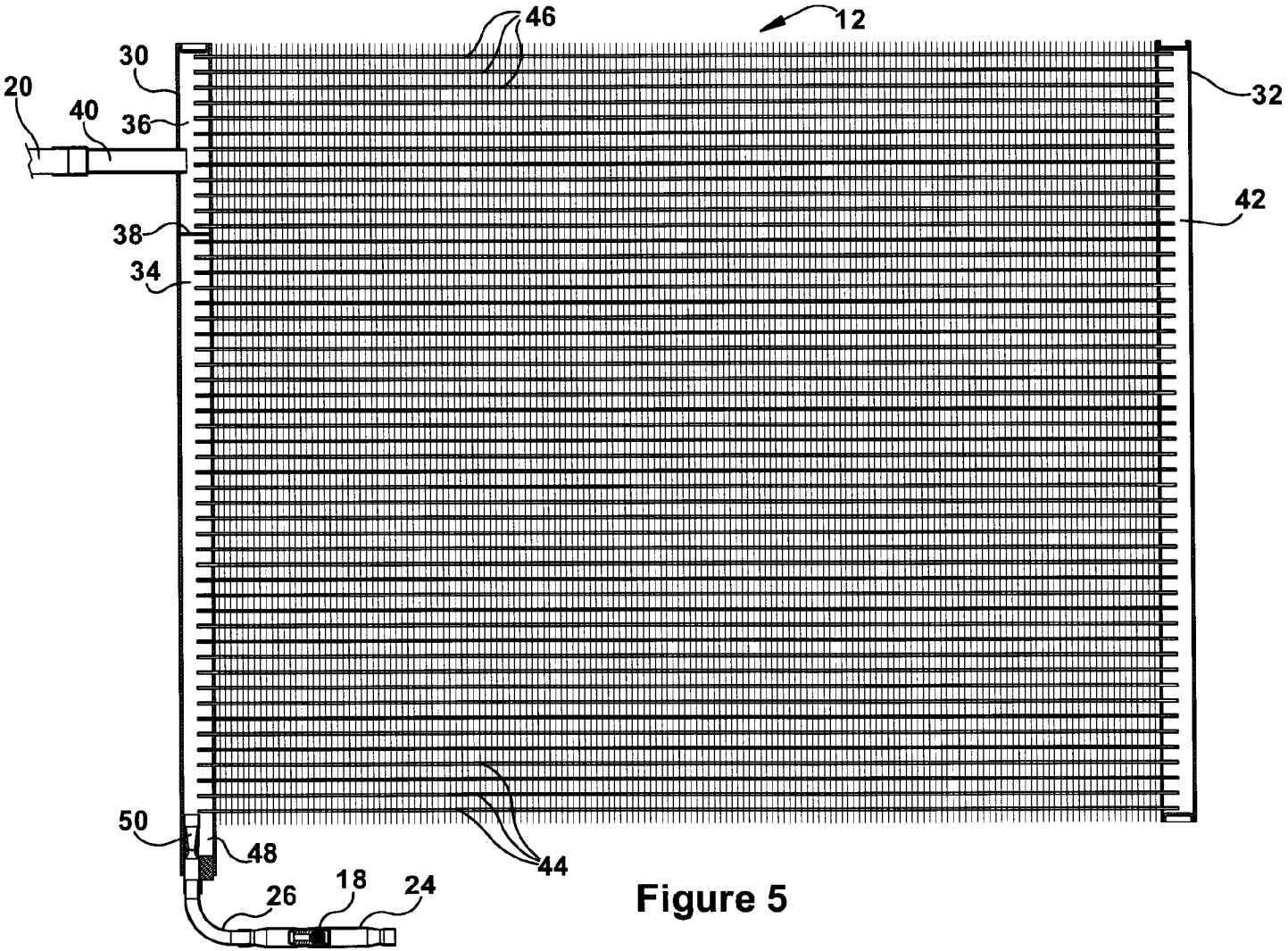
FIG. 5 is a sectional view of double-pass evaporating heat exchanger including the venturi device.

Referring now to FIG. 5, another evaporating heat exchanger 12 is shown. In this evaporator 12, both the inlet chamber 34 and the outlet chamber 36 are defined by the first header pipe 30, with a chamber-dividing wall 38 being positioned therebetween. The second header pipe 32 defines a return chamber 42. First pass channels 44 form flow passages from the inlet chamber 34 to the return chamber 42 and second pass channels 46 form flow passages from the return chamber 42 to the outlet chamber 36.

The channels 46, like the channels 44, can be microchannels. The channels 46 can be have approximately the same flow areas, or their flow areas can differ in a sequential, staggered, or other manner from each other and/or the channels 44. Likewise, the spacing between adjacent channels 46 can be the same or different throughout the length of the outlet chamber 36 and/or can be the same as, or different from the spacing of the channels 44. In any event, the first pass channels 44 and the second pass channels 46 together define a total heat-transfer area for the first and second passes of the evaporating heat exchanger 12.

The suction of the compressor 14 pulls the refrigerant fluid from the inlet chamber 34, through the first pass channels 44 to the return chamber 42, through the second pass channels 46 to the outlet chamber 36, and then through the outlet pipe 40 to line 20 to the compressor intake. The venturi device 50 is positioned at, in, or near an upstream area of the inlet chamber 34, to evenly distribute refrigerant mass to the channels 44 and/or to drain the liquid-accumulation-susceptible region 48.

In the evaporating heat exchanger shown in FIG. 5, the chamber-dividing wall 38 is positioned so that the inlet chamber 34 is longer (i.e., has a greater volume) than the outlet chamber 36. As the channels 44 and 46 are the same size and equally spaced, this length differential results in more first pass channels 44 than second pass channels 46. Thus, the heat-transfer area of the first pass channels 44 will represent a greater share of the total heat-transfer area than the second pass channels 46.

The heat-transfer area ratio of the first pass channels 44 and/or the second pass channels 46 relative to the total heat-transfer area can be selected to improve the performance of the evaporator 12. Thanks to the venturi device 50 (with or without the induced flow path 60), the refrigerant mass distribution within the inlet chamber 34 is uniform and heat-transfer through the first pass channels 44 is extremely efficient. However, due to mass inertia and/or liquid separation, the situation deteriorates in the return chamber 42 and heat-transfer through the second pass channels 46 is less efficient than that through the first pass channels 44. Thus, for a given total heat-transfer area, the greater the heat-transfer area of the first pass channels 44, and/or the lesser the heat-transfer area of the second pass channels 46, the more efficient the evaporator 12.

The gain in heat-transfer efficiency provided by unequal heat-transfer areas will usually need to be balanced against the need to maintain an acceptable pressure drop across the evaporator 12. A decrease in total flow area through the second pass channels 46 may cause too great of a pressure drop and possibly create other evaporator efficiency and/or heat-pump operational issues. Thus, the ratio of the heat-transfer area of the first pass channels 44 to the total heat-transfer area (and/or the ratio of the heat-transfer area of the second pass channels 44 to the total heat-transfer area) will typically be a compromise between efficient heat-transfer and an acceptable pressure drop (e.g., less than 10 psi). Specifically, for example, the heat-transfer area formed by the first pass channels 44 can be between about 60% and about 80% of the total heat-transfer area and/or the heat-transfer area formed by the second-pass channels 46 can be between about 20% and about 40% of the total heat-transfer area.

In the illustrated heat exchanger 12, the unbalanced heat-transfer ratio between the first pass channels 44 and the second pass channels 46 is accomplished by unequal division the first header pipe 30 into the inlet chamber 34 and the outlet chamber 36 (e.g., the placement of the dividing wall 38). However, other arrangements which accomplish and/or enhance this objective are possible and contemplated. For example, if package size is not an overly significant concern, the first pass channels 44 could be more closely spaced than the second pass channels 46. Likewise, the first pass channels 44 could have different sizes and/or shapes than the second pass channels 46.

Figure 6:
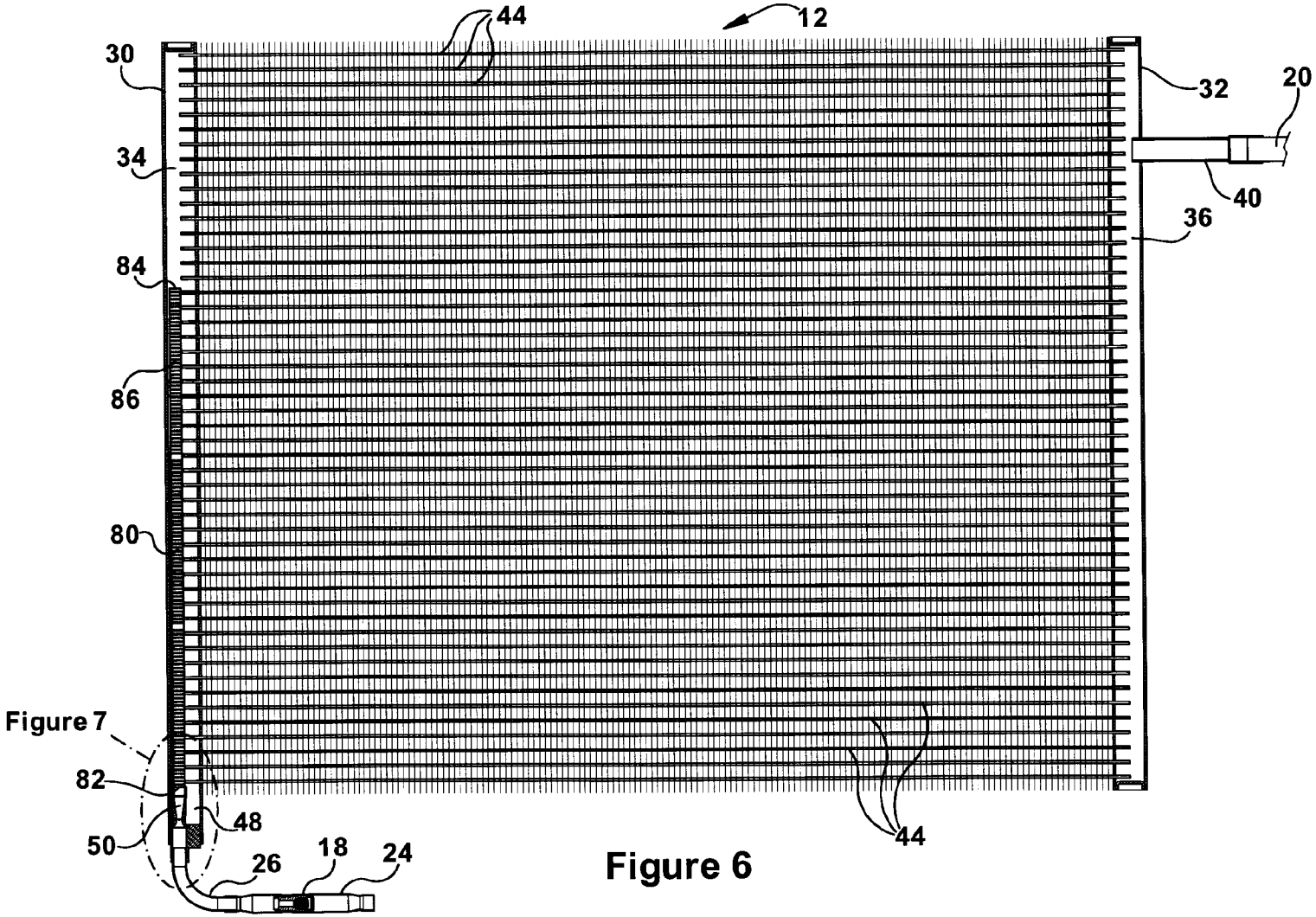
FIG. 6 is a sectional view of a single-pass evaporating heat exchanger including the venturi device and a flow-distributing conduit.
Figure 7:
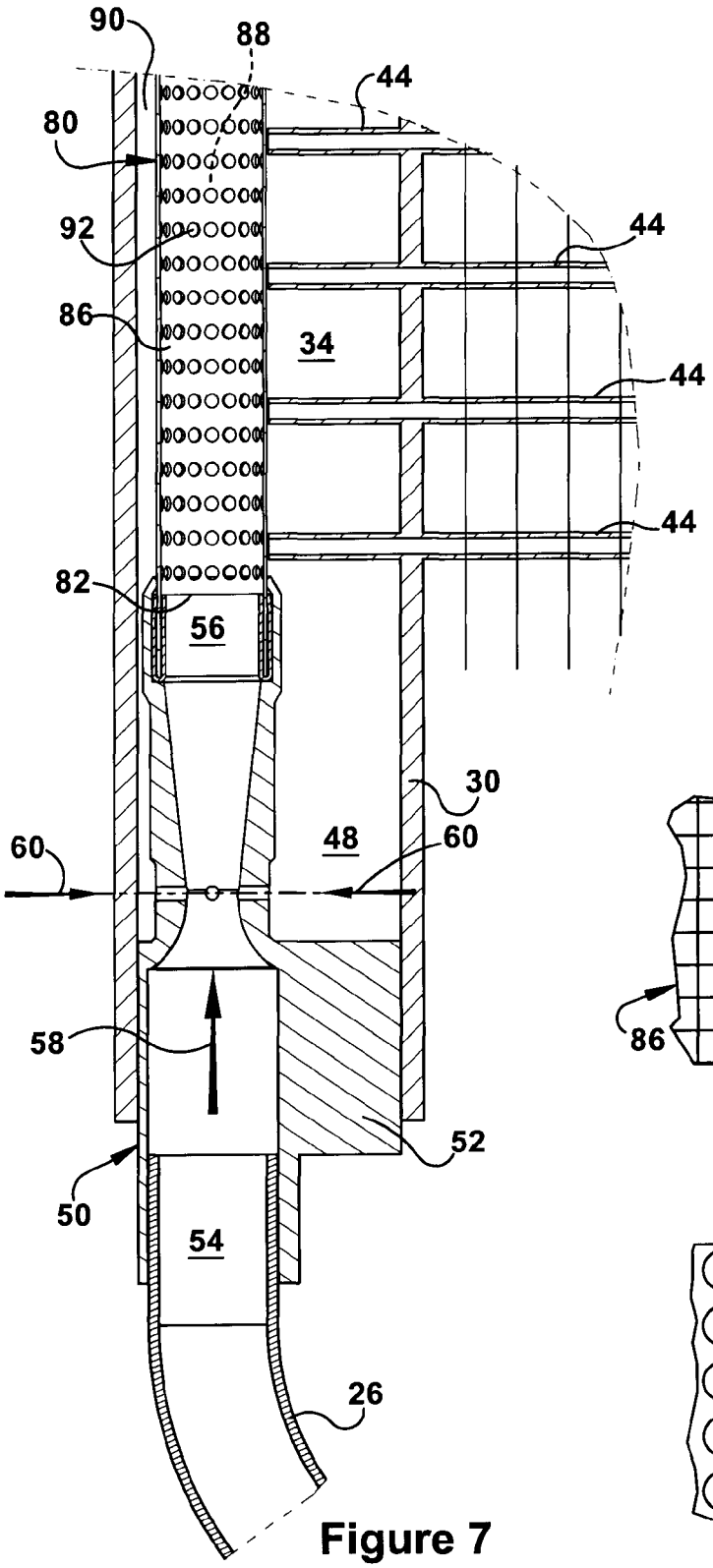
FIG. 7 is an enlarged view of the venturi device, the conduit, and surrounding sections of the evaporating heat exchanger.

Referring now to FIG. 6 and FIG. 7, another evaporating heat exchanger 12 is shown which is the same as the heat exchanger 12 shown in FIG. 2, except that a conduit 80 is used in conjunction with the venturi device 50 (with or without the induced flow path 60). The conduit 80 has an axial end 82 (e.g., a lower end), an opposite axial end 84 (e.g., an upper end), and a wall 86 (e.g., a cylindrical wall) extending therebetween. The axial end 82 can be open and is connected to the exit 56 of the venturi device 50 by, for example, the exit flange portion 66. The axial end 84 can be open into the inlet chamber 34, sealed with a lid, and/or covered with a screen. The conduit 80 and/or the cylindrical wall 86 can extend the entire length of the inlet chamber 34 or can extend only partially (e.g., at least about 50%, at least about 60%, at least about 70%, and/or at least about 80%) the length of the inlet chamber 34. If the conduit/wall extends the entire length of the inlet chamber 34, the axial end 84 can be attached to the upper wall of the header pipe 30.

Figure 8A:
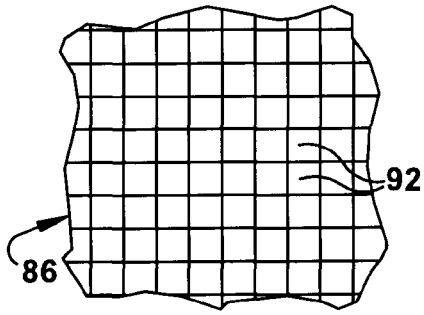
FIGS. 8A and 8B are close-ups of possible conduit material.
Figure 8B:
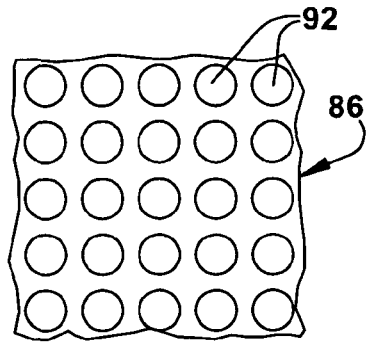

The conduit 80 can be viewed as separating the inlet chamber 34 into an inside-the-conduit region 88 and an outside-the-conduit region 90. The inlet of the channels 44 are located in the outside-the-conduit region 90. The wall 86 can be made be of a screen or mesh-like material (see FIG. 8A) whereby openings 92 are inherent in the wall material. Alternatively, the wall 86 can be made of an impervious material with openings 92 formed therein (e.g., by perforating, punching, cutting, etc.) (see FIG. 8B). In any event, the wall 86 has a plurality of openings 92 which establish communication between the regions 88 and 90. Although it may appear in the drawings that the inlet ends of the channel 44 are attached to the conduit wall 86, there is actually a small gap therebetween, and they communicate with the outside-the-conduit region 90.

As refrigerant fluid exits the venturi device 50 (through its exit 56), it enters the inside-the-conduit region 88 of the inlet chamber 34. The conduit 80 and/or the wall 86 resists flow so as to cause a back pressure (i.e., a higher pressure) within the inside-the-conduit region 88 relative to outside-the-conduit region 90. The back pressure is relatively the same throughout the region 88 whereby the flow of refrigerant fluid radially outward (through the openings 92) into the region 90 is approximately uniform along the length of the conduit/wall. This uniformity insures that the refrigerant mass flow to each of the channels 44 (which communicate with the outer region 84) is approximately even.

The conduit 80 can also provide additional mixing of the two phase fluid (gas and liquid), thereby further facilitating the introduction of homogenous refrigerant into each of the channels 44. As was alluded to above, vapor-liquid entering the inlet chamber 34 must contend with inertial and gravitational forces in the struggle for uniform mass distribution. Absent the two-phase-maintaining features of the venturi device 50 and/or the conduit 80, a vapor-liquid separation could occur resulting in the lower channels 44 carrying primarily liquid refrigerant and the upper channels 46 carrying primarily vapor refrigerant. Such single phase flow can cause a significant reduction in the heat transfer capability of the evaporator 12 which, as indicated above, can hurt performance, decrease efficiency, increase power consumption, diminish capacity and/or enlarge package size.

The conduit 80 can be sized, shaped, and/or positioned within the inlet chamber 34, and the openings 92 can be sized, shaped, and/or positioned, to obtain an optimum back pressure and appropriate mixing environment to ensure uniform mass distribution. This optimization could include the use of tapering conduit shapes (e.g., conical or stepped shapes), decreasing opening sizes, and/or increasing opening densities. Also, one or more diffuser plates and/or screens could be placed inside the wall 86 to create mixing-encouraging turbulence and/or to increase back pressure. The conduit 80 can be axially aligned with the venturi device 50 (e.g., offset to one side as in the illustrated embodiment) and/or can be axially aligned with the header pipe 30 or inlet chamber 34.

Figure 9:
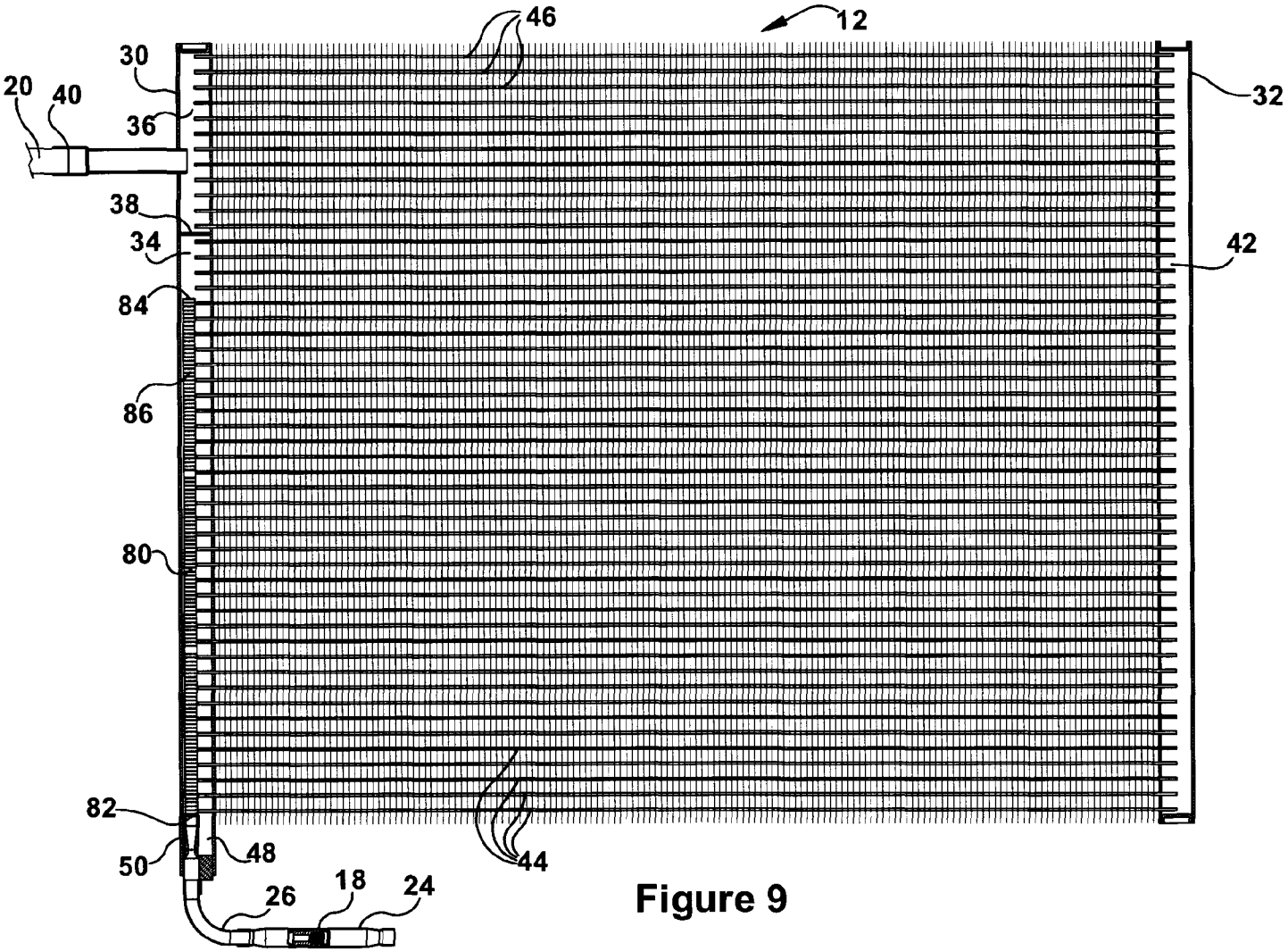
FIG. 9 is a sectional view of a double-pass evaporating heat exchanger including the venturi device and a flow-distributing conduit.

Referring now to FIG. 9, the venturi device 50 and the conduit 80 could also be used on a two-pass heat exchanger 12 such as is shown in FIG. 5. In this case, if the conduit 80 and/or the wall 86 extends the entire length of the inlet chamber 34, the axial end 84 can be attached to the chamber-dividing wall 38.

The heatpump system 10 shown in FIG. 1 includes a metering device 18 upstream of the evaporator 12. In the evaporating heat exchangers 12 shown in FIGS. 2, 5, 6 and 9, line 26 connects the metering device 18 to the entrance 54 of the venturi device 50. However, in some situations, it may be beneficial to combine the metering device 18 (e.g., a short-tube fixed-orifice metering device) with the venturi device 50. Such a one-piece metering-venturi device could be used alone or in conjunction with the conduit 80.

Although the heatpump system 10, the heat exchanger 12, the venturi device 50 and/or the conduit 80 have been shown and described with respect to a certain embodiment or embodiments, it is obvious that equivalent alterations and modifications will occur to others skilled in the art upon the reading and understanding of this specification and the annexed drawings. In regard to the various functions performed by the elements (e.g., components, assemblies, systems, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function. In addition, while a particular feature may have been described above with respect to only one or more of several illustrated embodiments, such feature may be combined with one or more other features of the other embodiments, as may be desired and advantageous for any given or particular application.

The invention claimed is:

1. An evaporating heat exchanger comprising:

a first header pipe;

a second header pipe;

an inlet chamber within the first header pipe, which inlet chamber has at a lower end of the first header pipe an area susceptible to liquid accumulation;

an outlet chamber within either the first header pipe or the second header pipe;

a multitude of channels extending between the first header pipe and the second header pipe and forming flow passages between the inlet chamber and to the outlet chamber; and a venturi device having a body defining an entrance for connection to a refrigerant input line, an exit communicating with the inlet chamber, a primary flow path extending from the entrance to the exit and including a venturi throat located upstream of the area susceptible to liquid accumulation in relation to the primary flow path, and an induced flow path extending from a side of the venturi throat to the area susceptible to liquid accumulation, whereby in operation of the heat exchanger liquid accumulated in the area susceptible to liquid accumulation will be drawn through the induced flow path and into the venturi for passage with primary flow through the primary flow path to the exit communicating with the inlet chamber.

2. An evaporating heat exchanger as set forth in claim 1, wherein the first header pipe is a substantially vertical pipe and wherein the liquid-accumulation-susceptible area is a lower area of the inlet chamber.

3. An evaporating heat exchanger as set forth in claim 1, wherein the outlet chamber is within the second header pipe and wherein the channels comprise single-pass channels from the inlet chamber to the outlet chamber.

4. An evaporating heat exchanger as set forth in claim 1, wherein the outlet chamber is positioned above the inlet chamber within the first header pipe.

5. An evaporating heat exchanger as set forth in claim 1, further comprising a return chamber within the second header pipe, wherein the outlet chamber is within the first header pipe, and wherein the channels comprise first pass channels from the inlet chamber to the return chamber and second-pass channels from the return chamber to the outlet chamber.

6. An evaporating heat exchanger as set forth in claim 5, wherein the first pass channels and the second-pass channels together form a total heat-transfer area; and wherein the heat-transfer area formed by the first pass channels is between about 60% and about 80% of the total heat-transfer area and/or wherein the heat-transfer area formed by the second-pass channels is between about 20% and about 40% of the total heat-transfer area.

7. An evaporating heat exchanger as set forth in claim 1, wherein the flow channels are positioned substantially parallel to each other.

8. An evaporating heat exchanger as set forth in claim 1, wherein the flow channels are microchannels.

9. An evaporating heat exchanger as set forth in claim 1, wherein the first header pipe and the second header pipe are positioned in a substantially vertical orientation, and wherein the flow channels are microchannels positioned substantially parallel to each other and substantially perpendicular to the header pipes.

10. An evaporating heat exchanger as set forth in claim 1, wherein the inlet chamber is free of baffles and diffusers.

11. An evaporating heat exchanger comprising:

a first header pipe;

a second header pipe;

an inlet chamber within the first header pipe, which inlet chamber has an area susceptible to liquid accumulation;

an outlet chamber within either the first header pipe or the second header pipe;

a multitude of channels extending between the first header pipe and the second header pipe and forming flow passages from the inlet chamber and to the outlet chamber;

a venturi device having a body defining an entrance for connection to a refrigerant input line, an exit communicating with the inlet chamber, a primary flow path extending from the entrance to the exit and including a venturi throat, and an induced flow path extending from a side of the venturi throat to the area susceptible to liquid accumulation, whereby in operation of the heat exchanger liquid accumulated in the area susceptible to liquid accumulation will be drawn through the induced flow path and into the venturi for passage with primary flow through the primary flow path to the exit communicating with the inlet chamber; and a conduit having an open axial end and radial flow passages, the conduit separating the inlet chamber into an inside-the-conduit region and an outside-the-conduit region connected by the radial flow passages;

wherein the exit of the venturi device is connected to the open axial end of the conduit whereby the primary flow path passes from the entrance to the exit and into the inside-the-conduit region of the inlet chamber.

12. A heatpump system comprising an evaporating heat exchanger as set forth in claim 1, a condensing heat exchanger, a compressor, and lines connecting these components together so that refrigerant fluid can flow therethrough.

* * * * *